US011319763B2

(12) United States Patent
Haugland

(10) Patent No.: US 11,319,763 B2
(45) **Date of Patent: *May 3, 2022**

(54) COLLECTING DEVICE AND METHOD FOR LOOSEN AND COLLECT DEBRIS IN A WELL

(71) Applicant: Qinterra Technologies AS, Stavanger (NO)

(72) Inventor: Lasse Haugland, Bryne (NO)

(73) Assignee: Qinterra Technologies AS, Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/794,383

(22) Filed: Feb. 19, 2020

(65) Prior Publication Data

US 2020/0248519 A1 Aug. 6, 2020

Related U.S. Application Data

(63) Continuation of application No. 15/558,236, filed as application No. PCT/NO2016/050046 on Mar. 15, 2016, now Pat. No. 10,669,795.

(30) Foreign Application Priority Data

Mar. 18, 2015 (NO) ..... 20150340

(51) Int. Cl.

| | |
|---|---|
| ***E21B 27/04*** | (2006.01) |
| ***E21B 37/02*** | (2006.01) |
| ***E21B 43/08*** | (2006.01) |
| *F04C 2/107* | (2006.01) |

(52) U.S. Cl.
CPC ..... *E21B 27/04* (2013.01); *E21B 37/02* (2013.01); *E21B 43/08* (2013.01); *F04C 2/1073* (2013.01)

(58) Field of Classification Search
CPC ..... E21B 27/04; E21B 37/02; E21B 43/08; F04C 2/1073
See application file for complete search history.

(56) References Cited

U.S. PATENT DOCUMENTS

| | | | | |
|---|---|---|---|---|
| 2,187,845 A | 1/1940 | Tatalovich | | |
| 6,289,986 B1 * | 9/2001 | Wright | E21B 43/126 | 166/117.7 |
| 7,048,056 B1 * | 5/2006 | Blake | E21B 37/00 | 166/312 |

(Continued)

FOREIGN PATENT DOCUMENTS

| | | |
|---|---|---|
| GB | 2338499 A | 12/1999 |
| NO | 315212 B3 | 7/2003 |

(Continued)

*Primary Examiner* — Caroline N Butcher
(74) *Attorney, Agent, or Firm* — GableGotwals

(57) ABSTRACT

A collecting device for loosening and collecting debris in a well comprises a first and second end portions, a collecting receptacle between the first and second end portions having at least one receptacle section and at least one screen receptacle, and a motor. The device at its first end includes a feed pipe, a conveying screw in feed pipe driven by the motor and arranged to move the debris in towards the collecting receptacle, and a tool at the leading end portion of the conveying screw. A method described of loosening and collecting debris in a well by the collecting device.

21 Claims, 7 Drawing Sheets

(56) References Cited

U.S. PATENT DOCUMENTS

| | | | |
|---|---|---|---|
| 2012/0186878 | A1 | 7/2012 | Eddison |
| 2014/0326510 | A1 | 11/2014 | Wessel |

FOREIGN PATENT DOCUMENTS

| | | | | | |
|---|---|---|---|---|---|
| NO | 20150339 | A1 | | 9/2015 | |
| WO | 0058602 | A1 | | 10/2000 | |
| WO | 03036020 | A1 | | 5/2003 | |
| WO | WO-03036020 | A1 | * | 5/2003 | ..... E21B 37/02 |
| WO | 2010120454 | A1 | | 10/2010 | |
| WO | 2013079935 | A2 | | 6/2013 | |
| WO | 2014031006 | A1 | | 2/2014 | |
| WO | WO-2014031006 | A1 | * | 2/2014 | ..... E21B 43/084 |
| WO | 20150339 | A1 | | 9/2015 | |

* cited by examiner

COLLECTING DEVICE AND METHOD FOR LOOSEN AND COLLECT DEBRIS IN A WELL

CROSS REFERENCE TO RELATED APPLICATIONS

This application is a continuation application of U.S. application Ser. No. 15/558,236 filed 14 Sep. 2017 which claims priority to PCT Application NO2016/050046 filed 15 Mar. 2016 which claims priority to Norwegian Application 20150340 filed 18 Mar. 2015, each of which is incorporated herein by reference.

BACKGROUND OF THE INVENTION

This invention relates to a collecting device for loosening and collecting debris in a well, especially in a petroleum well. It relates, more particularly, to a collecting device comprising a feed pipe with a rotatable conveying device on the suction side of a pump, the conveying device being arranged to move debris up to the pump. The debris is conveyed through the pump when the pump is active, and is collected in a portion of a collecting receptacle on the delivery side of the pump. The pump works as a valve when the pump is passive, so that collected debris will not flow out of the collecting receptacle as the collecting device is transported up to the surface and out of the well where the collecting receptacle is emptied. At least a portion of the wall of the collecting receptacle is formed as a wall screen. The invention also includes a method of collecting debris in a well and carrying the debris out of the well.

In what follows, the particle size ranges are defined in accordance with the Udden-Wentworth scale. Clay particles are less then 0.004 mm (0.00015 in) in size and silt particles are between 0.004 mm and 0.0625 mm (0.0015-0.0025 in) in size. By comparison, the grain size of very fine sand is between 0.0625 and 0.125 mm (0.0025-0.0049 in) and the grain size of fine sand between 0.125 and 0.25 mm (0.0049-0.010 in). According to ISO 14688-1, the clay particles are less than 0.002 mm in size.

It happens relatively often that debris in the form of silt, sand, loosened scale, drilling fluid particles, cuttings and other matter settle on the inside of a pipe belonging to a well in a ground. The well may be a well that produces oil or a well that produces a gas. Such debris may, if it accumulates to a sufficient degree, be highly obstructive to a fluid flow through the pipe. Normally, the deposited matter is removed by means of a collecting tool. It is know to use various types of collecting tools in connection with coiled-tubing operations, snubbing or drilling operations.

Even in smaller amounts, debris may be a problem even if it does not affect the well production to any substantial degree. The debris may be an obstacle to maintenance work, for example, especially when it is a question of light processes such as wireline operations. It is not unusual for deposited sand and other matter in a well, even in moderate amounts, to prevent tools from reaching the desired position in the well during maintenance work.

In petroleum wells, so-called sand screens are often used to prevent or reduce the entry of particulate debris into the well.

One method includes screens, or pipes with slots and screens. One design of screens is known as a wire-wrapped screen. A wire-wrapped screen includes a keystone-shaped wire in a corrosion-resistant material which has been spun into a spiral and formed into a cylinder. The wire is usually welded to a number of longitudinal rods distributed along the internal circumference of the screen. The spun screen may possibly be welded to a pipe with longitudinal slots and constitutes a pipe-based wire-wrapped oil-well screen. It is also known to use two concentric wire-wrapped screens, one on the outside of the other. The annular space formed between the screens may be filled with gravel-packed sand. This solution is termed a "dual-wrapped pre-packed well screen".

The keystone-shaped wire is wrapped in a spiral with the widest part facing outwards and the narrowest part facing inwards. Thereby a wedge-shaped opening is formed between two adjacent openings. The narrowest axial distance between two adjacent wires is normally denominated in units of 0.001 in (0.0254 mm). The unit referred to is termed the "gauge" of the screen. A 6-gauge screen will have a distance of 0.006 in (0.15 mm) between adjacent wires.

Another type of screen that is used in sand screens is a premium screen. A premium screen uses a woven metal mesh.

It is common to divide oil wells and gas wells into the following groups:

Conventional wells, in which the largest angular deviation from the vertical direction is approximately 65 degrees.

Extended Reach Drilling (ERD) wells, in which the angular deviation relative to the vertical direction is larger than 65 degrees.

Horizontal wells, in which some well sections have an angular deviation of approximately 90 degrees relative to the vertical direction.

According to the prior art, in conventional wells, a sand collector which is lowered into the well, for example by means of a wireline, is used. The sand collector includes at least one collecting chamber. There are sand collectors that work in different ways. A sand collector of a first type may be hammered down into the debris; a sand collector of another type may suck into the debris by means of a built-in piston arrangement or by a plate opening to a room holding atmospheric pressure, whereby the well pressure moves the debris into the collecting chamber.

Most prior-art methods are simple and relatively inexpensive to implement. They are thus well suited for conventional wells in which the debris forms bridges that cover the entire pipe cross section and in which it is therefore easy to fill the collecting chambers with debris by means of one of the methods mentioned above.

Two conditions, in particular, distinguish ERD and horizontal wells from conventional wells as far as debris and methods of getting the debris out are concerned. Firstly, bridges of debris rarely form in the pipe, as, because of gravity, the debris settles in the downward half of the pipe circumference. Prior-art collectors which are arranged to be sucked down into the debris are not efficient when the debris is distributed along the pipe, as the collectors will, in the main, be filled with fluid.

Secondly, the part of the gravitational force acting on the tool in the axial direction of the well pipe decreases with the angular deviation of the well relative to the vertical axis. In horizontal well sections, the gravitational force on the tool in the axial direction of the well pipe is nil. Wireline tools that are dependent on the axial weight component of the tool weight to work satisfactorily cannot be used under such conditions. The tools may be supplemented with wireline tractors to improve propulsion.

The Norwegian patent 315212 discloses a collecting device which is provided with a conveying screw, the leading portion of the conveying screw being provided with a scraper or some other practical tool. The conveying screw, which is driven by a motor, is arranged to move loosened debris into a collecting receptacle. The device according to NO 315212 has proved efficient also in ERD and horizontal wells, but has a relatively low collecting capacity.

The patent publication WO2010/120454 shows a collecting device for use together with a slickline. The collecting device includes a pump in the upper portion of the device. The pump sucks debris up from the well through an opening in the free, lower end portion of the device. The collecting chamber of the device is positioned on the suction side of the pump. A filter which is positioned between the collecting chamber and the pump retains the debris in the collecting chamber while fluid passes the filter and the pump. The pump may be a Mono pump. A Mono pump is also termed a Moineau pump after the inventor, or a PCP pump (Progressive Cavity Pump). The operation of the Mono pump is known to a person skilled in the art and is not described in further detail.

The patent publication WO 2014/031006 shows a collecting device particularly suitable for collecting fine-particulate matter in a well pipe. The fine-particulate matter may include clay and especially silt. The collecting device is provided with a screen in the wall of a collecting receptacle. The screen may be a wire-wrapped screen or a so-called premium screen. The screen is positioned in a flow path on the delivery side of a pump.

The patent publication GB 2338499 shows a collecting receptacle for use together with a wireline. The collecting device includes a motor and a pump in the lower portion of the device. The motor is provided with a central passage through the inner rotor of the motor. Matter is carried through the pump and the motor and to a collecting chamber on the delivery side of the pump. A screen at the upper portion of the collecting device retains matter in the collecting chamber and allows liquid to escape.

Collecting devices for removing debris in a well include elongated, tubular collecting receptacles. Together with other necessary equipment, such as a tool for loosening the debris, a motor for driving the tool and a unit for displacing the collecting device, such as a wireline tractor, the collecting device and equipment typically constitute an equipment string of 15 metres. This equipment string is sluiced into the well in a known manner through a lubricator above the wellhead. The lubricator may have a capacity for sluicing known well tools which are typically up to 30 metres long into the well. The known collecting devices thus do not turn the lubricator capacity to account. This is owing to the known collecting devices having a limited capacity to fill elongated collecting receptacles. Therefore it does not matter if the collecting device is provided with a longer collecting receptacle as it cannot be turned to account. Typical known collecting devices have a capacity of removing 20-30 litres of debris on each trip into the well. There is a need for a collecting device that has a larger capacity, for example of removing 100 litres on each trip. Such a collecting device will, to a considerable extent, increase the efficiency of the work of removing debris from a well. An alternative to using collecting devices as described is to provide coiled tubing with a suitable collecting tool. Mobilizing equipment is considerably more extensive for a coiled-tubing operation than for an operation using wireline equipment. Therefore, there will be a considerable saving if wireline equipment may be used as an alternative to coiled tubing for the removal of debris in the well.

Collecting devices as described must be arranged in such a way that collected matter will not flow out of the collecting receptacle when the collecting device is carried up to the lubricator of the well. Especially in the vertical portion of the well, collected matter could flow out of the collecting receptacle. Such outflow may be prevented by the colletting device being provided with a check valve in its lower portion. The check valve may be a flap valve.

A further problem is that, when loosened, debris that also includes clay and silt will mix with the fluid and not immediately settle out from the fluid, but flow with this out of the collecting device as well. Clay and silt may be retained with filters, but known filters will soon clog up, which reduces the collecting capacity of the collecting device.

The patent publication WO 2014/031006 shows a solution in which fine particles are retained in the collecting receptacle when the wall thereof is at least partially formed of a wall screen. The wall screen gives a large filter area. The collecting device shown in WO 2014/031006 is less suitable if the debris consists of a large portion of sand in proportion to the fine-particulate matter, and especially if the debris includes, for example, metal chips from grinding operations or milling operations carried out in the well pipe. The collecting device is also less suitable if the debris is hard-packed, as the collecting device sucks the debris into the collecting device without loosening the debris in advance.

The collecting device disclosed in the patent publication NO 315212 is suitable for loosening hard-packed debris with a tool at the leading end. Matter with a relatively large portion of particulate debris in proportion to fluid is suitable for being carried into this collecting device. Matter with a relatively large portion of fluid in proportion to particulate debris is less suitable and reduces the efficiency of the collecting device. The collecting receptacles of such collecting devices are elongated. A shaft extending concentrically through the collecting receptacle from a motor at one end portion to a tool at the other end portion will have to be supported by bearings in the collecting receptacle. Such bearings will hinder the displacement of collected matter inside the collecting receptacle. This is particularly the case if the matter has a large portion of particulate debris in proportion to fluid.

There is a need to provide a collecting device which can, better than known collecting devices, loosen hard accumulations of debris, grind down large particles into smaller particles, collect debris substantially consisting of clay and silt, collect debris consisting of clay, silt, sand and possibly metal particles, and which has good collecting capacity. There is also a need for a collecting device which is better than known collecting devices on some of these points.

The invention has for its object to remedy or reduce at least one of the drawbacks of the prior art or at least provide a useful alternative to the prior art.

The object is achieved, according to the invention, through the features that are specified in the description below and in the claims that follow.

The invention is defined by the independent claims. The dependent claims define advantageous embodiments of the invention.

According to a first aspect, the invention relates to a collecting device for loosening and collecting debris in a well, the collecting device including:

- a first end portion and a second end portion;
- a collecting receptacle between the first end portion and the second end portion, the collecting receptacle including at least one receptacle section and at least one screen receptacle with a wall screen;
- a motor;

and the collecting device, at its first end portion, including:

a feed pipe;

a conveying device in the feed pipe driven by the motor so that the conveying device is arranged to move the debris in towards the collecting receptacle; and a tool at the leading end portion of the conveying device.

The conveying device may be a conveying screw.

The collecting device may include a Mono pump and at least one screen receptacle in a flow path on the delivery side of the Mono pump. A receptacle section which includes a wall screen forms a screen receptacle. The wall screen may be formed of a premium screen. The wall screen may be formed of a wire-wrapped screen. The wire may be a keystone-shaped wire. The wall screen may be of a construction corresponding to that known from a wire-wrapped oil-well screen.

A Mono pump has some characteristics that are advantageous when used in such a collecting device. A Mono pump has relatively little sensitivity to particulate matter such as gravel and the like. The Mono pump can be designed to give a sufficient flow rate even at a relatively low number of revolutions.

The collecting device is well suited for being displaced into and out of a well, especially a petroleum well, by means of a wireline tractor. With advantage, the motor of the collecting device may be supplied with energy from the wireline tractor, typically in the form of electrical power or a hydraulic fluid flow.

The debris which is moved into the collecting receptacle by means of the conveying device is mixed with fluid. The fluid outlet, which is typically covered by a screen, makes it possible for the fluid to follow the flow path through the collecting device. By using a Mono pump in this flow path, the intensity of the fluid flow is increased and thereby the amount of debris entering the collecting receptacle. A greater degree of filling is thus achieved in the collecting receptacle than in known collecting devices before the collecting device will have to be emptied.

Debris present in the petroleum well is either loose or is loosened by means of the tool which may be attached to the leading end portion of the conveying device. The tool may, for example, include hard-metal pieces or other suitable materials. In some cases, the tool may include brushes.

The collecting device may further include at least one receptacle section in the flow path on the suction side of the Mono pump. By using a modular structure, the collecting device may be adapted for the prevailing conditions with respect to both the number of receptacle sections, which determines the size of the collecting receptacle, and the relative position of the Mono pump in the collecting device.

Much of the debris could fall out of the fluid flow in the receptacle section on the suction side of the Mono pump before the fluid passes the Mono pump. In some cases, it may be advantageous for the distance of the Mono pump to the conveying device to be smaller than the distance to the fluid outlet. At least a portion of the debris in the fluid flow will then pass through the Mono pump. This may have the advantage of the debris then flowing with the pressurized fluid further into the collecting receptacle.

The conveying device may be rotatable and connected to the motor in a motor housing. The motor housing may be positioned in the end portion of the collecting device, and the motor may drive the conveying device via a driveshaft. The conveying device may typically be formed of a conveying screw with a screw blade.

A motor housing with the motor may be position in the second end portion, and the motor drives the Mono pump via a driveshaft. The motor may alternatively be positioned in a lower portion of a receptacle section on the delivery side of the Mono pump and the motor drives the Mono pump via a driveshaft.

The conveying device may be rotatable and connected to the Mono pump by an intermediate shaft. The conveying device may typically consist of a conveying screw with a screw blade. The Mono pump may be connected to the conveying device so that the Mono pump and the conveying device are connected to a common shaft. The shaft, which may be articulated or flexible in some other way, is arranged to receive the eccentric rotation characteristic of the rotor movement of the Mono pump.

In its wall, the feed pipe may at least include one through main opening directed radially. The feed pipe may be provided with a plurality of through main openings directed radially, distributed around the circumference of the feed pipe. The at least one through main opening directed radially may be elongated in the longitudinal direction of the collecting device. In its wall, the feed pipe may at least include one through relief opening directed radially. The feed pipe may be provided with a plurality of through relief openings directed radially, distributed around the circumference of the feed pipe. In a wall, the collecting device may include at least one through auxiliary opening directed radially at the Mono pump, on the suction side of the Mono pump. The collecting device may be provided with a plurality of through auxiliary openings directed radially, distributed around the circumference of the collecting device. At least one of the main opening, the relief opening and the auxiliary opening may be closable.

In a portion, the driveshaft may be provided with a screw blade. The upper portion of the driveshaft may be smooth.

At a standstill, the Mono pump may constitute a check valve between the at least one receptacle section on the delivery side of the Mono pump and the feed pipe. This has the advantage of the Mono pump maybe making a separate closing device between the tool and the collecting receptacle superfluous. Such a closing device is necessary in many cases in order to prevent leakage of collected matter from the collecting receptacle and out through the feed pipe when the collecting device is being displaced upwards in the vertical part of the petroleum well.

The conveying device may be supported in an outer bearing housing in the feed pipe, the outer bearing housing may be provided with through openings directed axially and the outer bearing housing may be provided with a closing device on the side facing the conveying device. The closing device may be a flap valve. The conveying device may be supported in an inner bearing housing in the feed pipe, and the inner bearing housing may be provided with through openings directed axially.

According to a second aspect, the invention relates to a method of loosening and collecting debris in a well by means of a collecting device as described above. The method includes:

displacing the collecting device inside a well pipe up to debris in the well pipe;

activating the collecting device by starting the conveying device and the tool;

moving the tool into the debris to loosen the debris;

separating debris and fluid in the collecting receptacle by letting fluid flow out through the wall screen;

displacing the collecting device back and out of the well; and emptying the collecting receptacle of the collecting device of collected debris.

The conveying device may comprise a conveying screw.

The method may further include:

providing the collecting device with a Mono pump;

activating the collecting device by starting the Mono pump, the conveying device and the tool;

mixing the debris with an ambient fluid and carrying the debris up to the suction side of the Mono pump;

passing the diluted debris through the Mono pump and into the collecting receptacle on the delivery side of the Mono pump; and stopping the Mono pump so that separated debris in the collecting receptacle is prevented from flowing out of the collecting device through the feed pipe when the collecting device is displaced back and out of the well pipe.

The method may further include:

providing the collecting device with a main opening, a relief opening and an auxiliary opening;

mixing debris in the feed pipe with ambient fluid which is flowed into the feed pipe through at least one of the main opening or the relief opening, or mixing debris with ambient fluid in the collecting receptacle by flowing ambient fluid through the auxiliary opening.

The method may further include flowing ambient fluid into the feed pipe or the collecting receptacle selectably through at least one of the main opening, the relief opening or the auxiliary opening by closing at least one of the main opening, the relief opening so or the auxiliary opening.

The collecting device and the method according to the invention provide for increased efficiency in clean-up work in connection with ERD and horizontal petroleum wells.

In what follows, examples of preferred embodiments are described, which are visualized in the accompanying drawings in which:

FIG. 2 shows a longitudinal section of the collecting device of FIG. 2;

Figure 2:
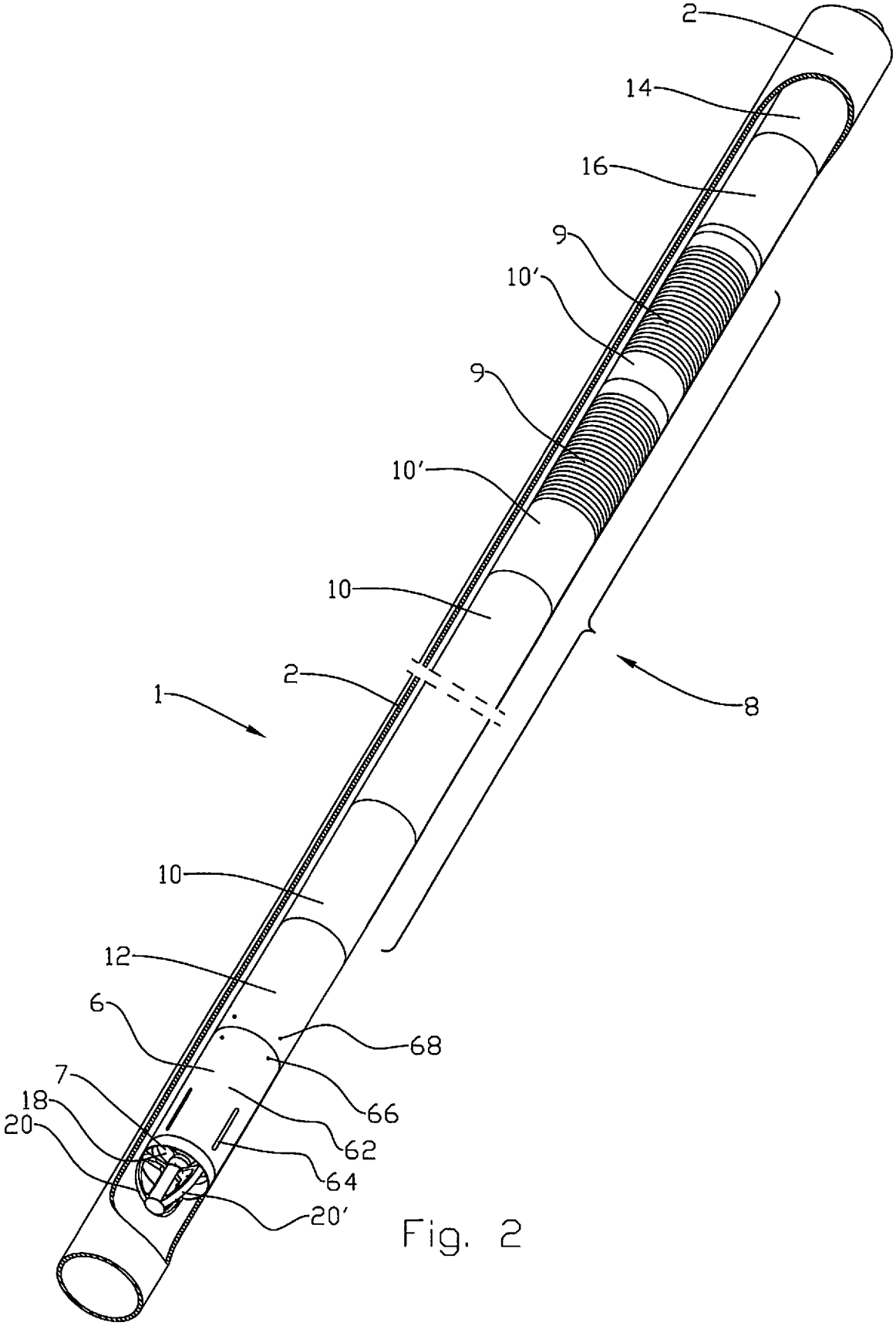
FIG. 2 shows, in perspective, a collecting device according to the invention during work in a well pipe.

In the drawings, the reference numeral 1 indicates a collecting device which is shown in a well pipe 2 in FIG. 2. In its first end portion, the collecting device 1 includes a feed pipe 6 with an inlet 7, the feed pipe 6 being in fluid communication with a collecting receptacle 8. The collecting receptacle 8, which is typically of a modular structure, may include one or more receptacle sections 10. In its second end portion, the collecting device 1 further includes a top section 16, a motor housing 14 and a coupling piece (not shown) which may be attachable to a wireline (not shown) or to a wireline tractor (not shown). The wireline tractor can move the collecting device 1 in the well pipe 2.

A conveying device 18 is arranged in the feed pipe 6. The conveying device 18 may be rotatable and is shown here in the form of a conveying screw 18'. The conveying device 18 is provided with a tool 20 at its leading end portion, for loosening debris inside the well pipe 2. The tool 20 is shown here as a scraper 20'. The tool 20 may be of other types such as a brush, a so-called rock bit or a so-called PDC bit. The type of tool 20 is chosen according to the type of debris to be removed from the well pipe 2.

The conveying device 18 is supported in an outer bearing housing 30 which is provided with through openings 33 directed axially for conveying debris through the outer bearing housing 30. The conveying device 18 is further supported in an inner bearing housing 32, see FIG. 3. The inner bearing housing 32 is provided with through openings 34 directed axially for conveying debris through the inner bearing housing 32. The openings 34 also work as screen openings for preventing larger particles from being conveyed into the collecting receptacle 8. The outer bearing housing 30 is further, on its side facing the conveying device 18, provided with a closing device 36 which is arranged to prevent a fluid flow in the direction from the feed pipe 6 to the tool 20. The closing device 36 may comprise a flap valve. In some cases in which the debris has a high viscosity, the closing device 36 may be omitted to facilitate the subii) sequent emptying of the collecting device 1. Particles passing the through openings 33 directed axially, but being too large to pass the through openings 34 directed axially, are retained by the closing device 36. These particles will be in the feed pipe 6 when the collecting device 1 is transported out of the well pipe 2.

A Mono pump 12 is positioned between the inner bearing housing 32 and the collecting receptacle 8. The conveying device 18 is thus positioned on the suction side of the Mono pump 12, and the collecting receptacle 8 is positioned on the delivery side of the Mono pump 12, as is shown in the embodiments according to FIGS. 3-5. The through openings 34 directed axially prevent large particles that can ruin the Mono pump 12 from being carried all the way up to the inlet (not shown) of the Mono pump 12.

The motor 22 in the motor housing 14 drives the Mono pump 12 via a driveshaft 28.

Figure 3:
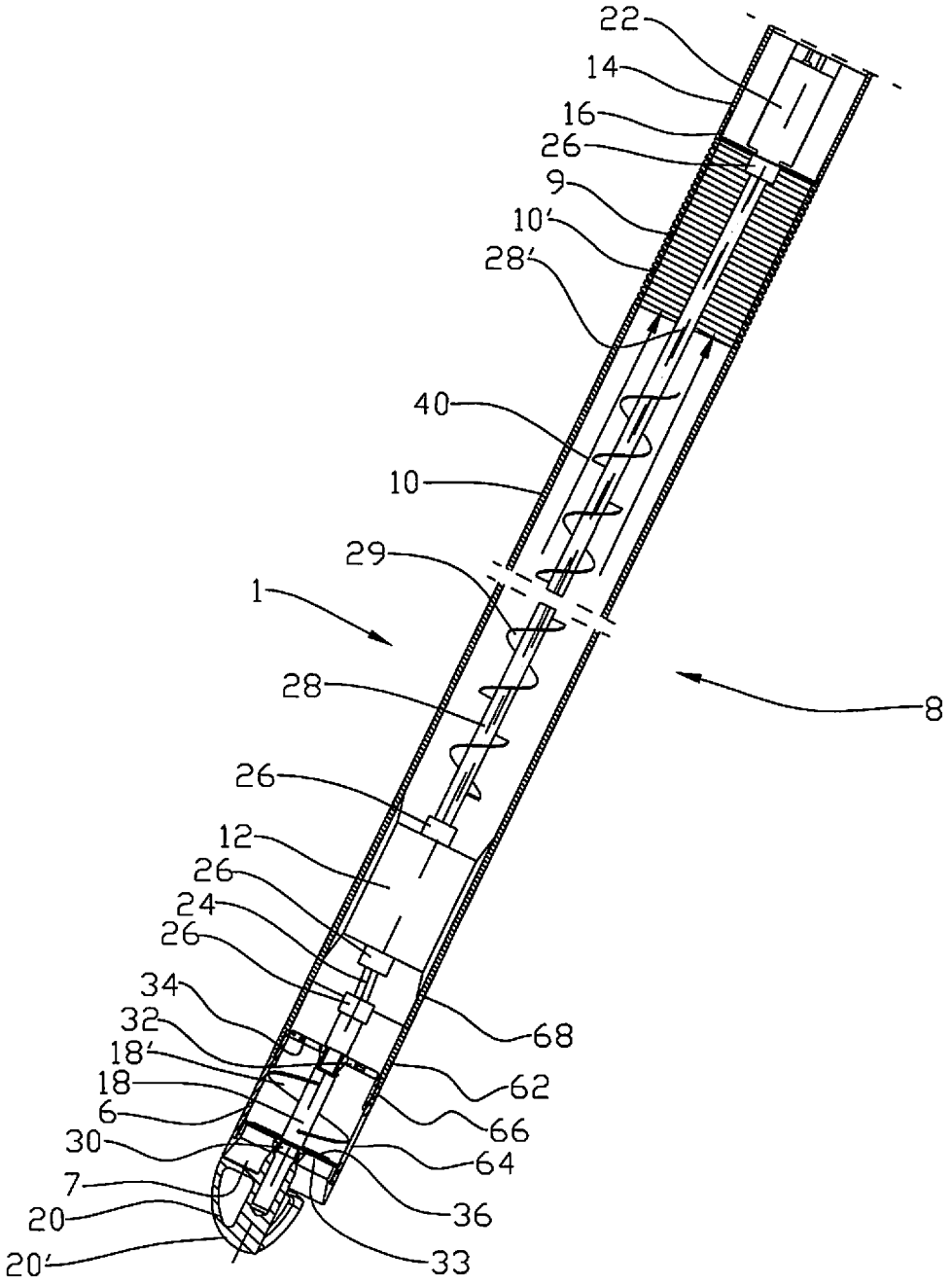
FIG. 3 shows a longitudinal section, on the same scale as FIG. 3, of the collecting device in an alternative embodiment.

Because of the way the Mono pump 12 operates, the driveshaft 28 is provided with articulations 26. An intermediate shaft 24, which is also articulated, extends from the Mono pump 12 to the conveying device 18. The driveshaft 28 may be provided with a number of screw blades 29 as shown in FIG. 3. The motor 22 thus drives the conveying device 18 and the tool 20 via the driveshaft 28, the Mono pump 12, the intermediate shaft 24 and associated articulations 26.

Figure 1:
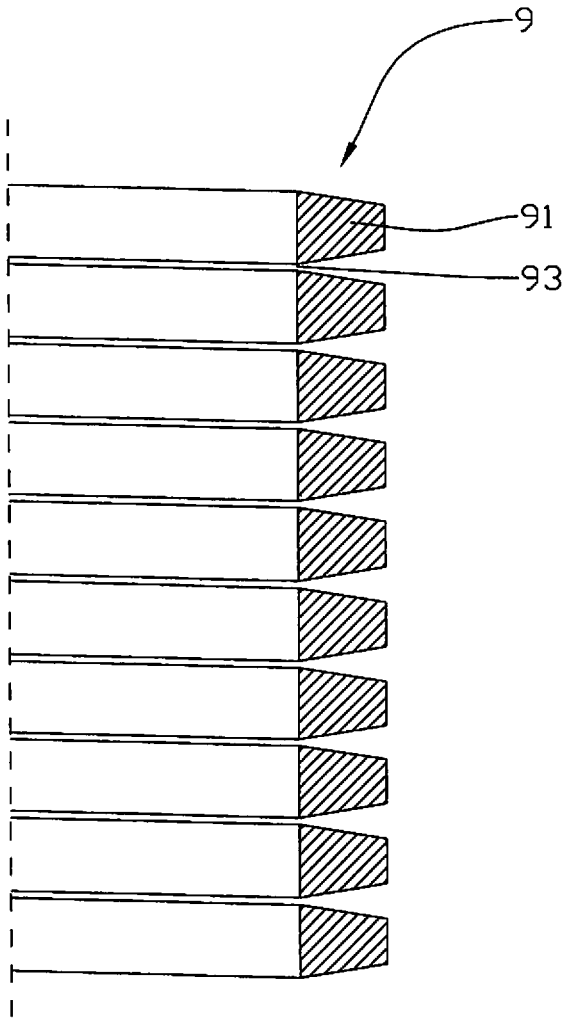
FIG. 1 shows a principle drawing of a wall screen.

The collecting receptacle 8 may comprise several receptacle sections 10. At least one of the receptacle sections 10 is provided with a wall screen 9 and forms a screen receptacle 10'. FIG. 1 shows a principle drawing in section of the wall screen 9 in the form of a wire-wrapped screen. Keystone-shaped wires 91 form openings 93 between them, with a spacing chosen according to the particle size that should be able to pass the wall screen 9. The wall screen 9 may extend axially over the entire length of the screen receptacle 10'. In another embodiment, the wall screen 9 may constitute a portion of the length of the screen receptacle 10'. In an alternative embodiment, the wall screen 9 may consist of a premium screen.

Each receptacle section 10, 10' may include a portion of the driveshaft 28 and the screw blade 29. Each receptacle section 10, 10' is provided with an upper shaft support (not shown) and a lower shaft support (not shown). In one embodiment, the receptacle section 10, 10' that is positioned the nearest to the motor 22 may be provided with a driveshaft 28 with an upper smooth portion 28' nearest to the motor 22, see FIG. 3.

The modular structure makes it possible to combine receptacle sections 10 with screen receptacles 10' of different designs. This is advantageous as the overall screen area may be varied and the positioning of wall screens 9 may be varied along the length of the collecting receptacle 8. The collecting device 1 may therefore easily be adapted for the conditions in the well in question.

In a lower portion of a wall 62, the feed pipe 6 is shown provided with a plurality of through main openings 64 directed radially. In its upper portion, the wall 62 is shown provided with a plurality of through relief openings 66 directed radially. The main openings 64 are shown as elongated openings in the longitudinal direction of the collecting device 1. The openings 64, 66 are distributed around the circumference of the feed pipe 6.

The collecting device 1 is further shown provided with through auxiliary openings 68 directed radially in a wall right below the stator (not shown) of the Mono pump 12.

The openings 64, 66 and 68 may selectably and independently of each other be closed and opened with closing devices (not shown).

The feed pipe 6, the Mono pump 12, the collecting receptacle 8 with the screen receptacle 10', which includes the wall screen 9, form a flow path 40 through the collecting device 1.

The fluid following the flow path 40 will choose the flow path 40 offering the least flow resistance. This will usually be with an outlet at the bottom of the collecting receptacle 8. The fine matter like clay, silt and fine sand will gradually clog up a portion of the wall screen 9, so that the flow path 40 changes and reaches the top section 16. Gradually, a more or less fluid-tight channel will form within the collecting receptacle 8. The Mono pump 12 may push or press the mixture of fluid and debris all the way up to the top section 16.

Figure 4:
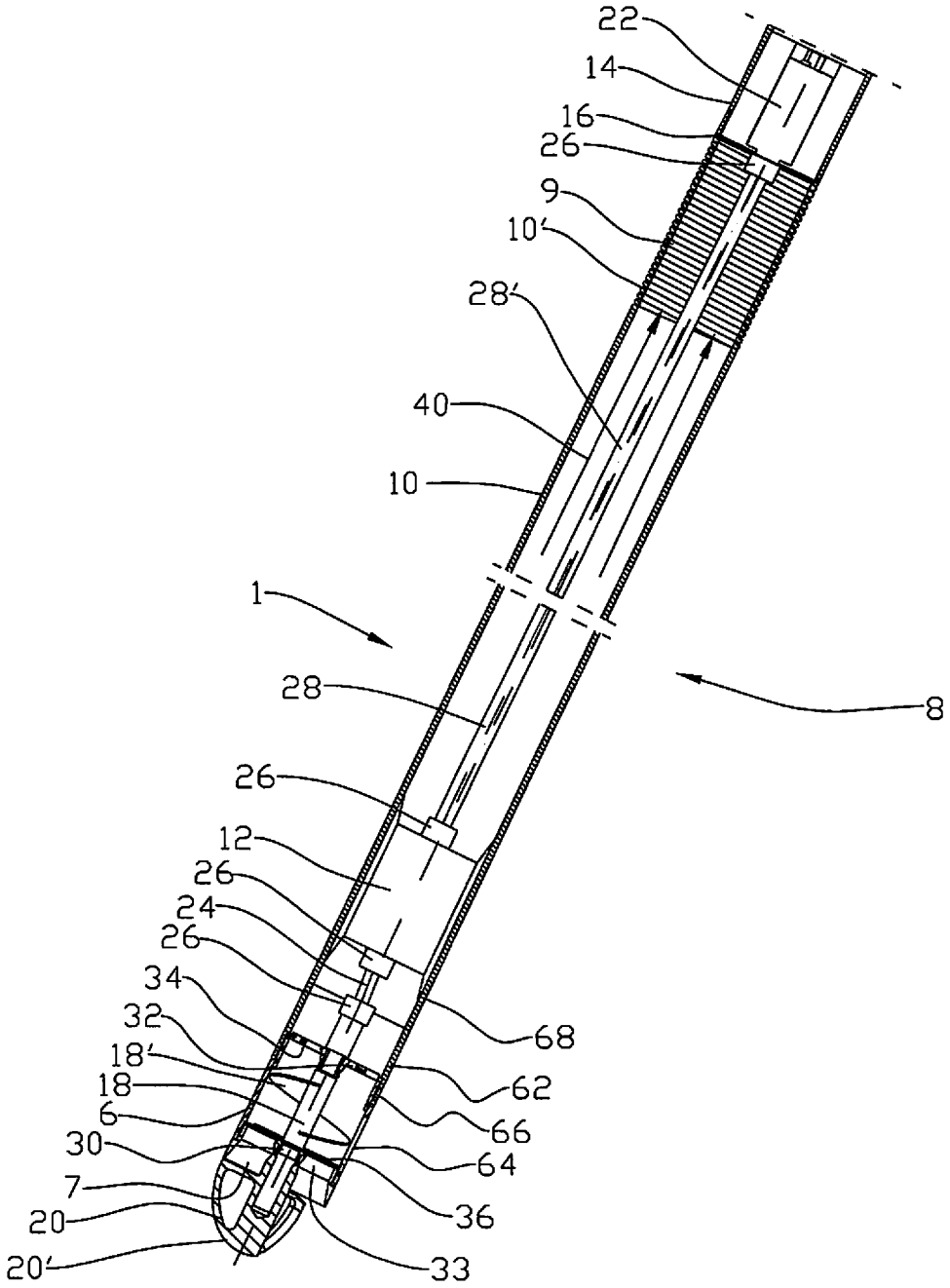
FIG. 4 shows a longitudinal section, on the same scale as FIG. 3, of the collecting device in a further alternative embodiment.

The collecting device 1 is shown in an alternative embodiment in FIG. 4. In this embodiment, the smooth portion 28' of the driveshaft 28 has been carried through the entire collecting receptacle 8. This may be advantageous when the mixture of debris and fluid contains much fluid and the Mono pump 12 exerts so great a pressure that the mixture may flow all the way to the top section 16. Screw blades 29, if any, may slow down the mixture along the flow path 40.

Figure 5:
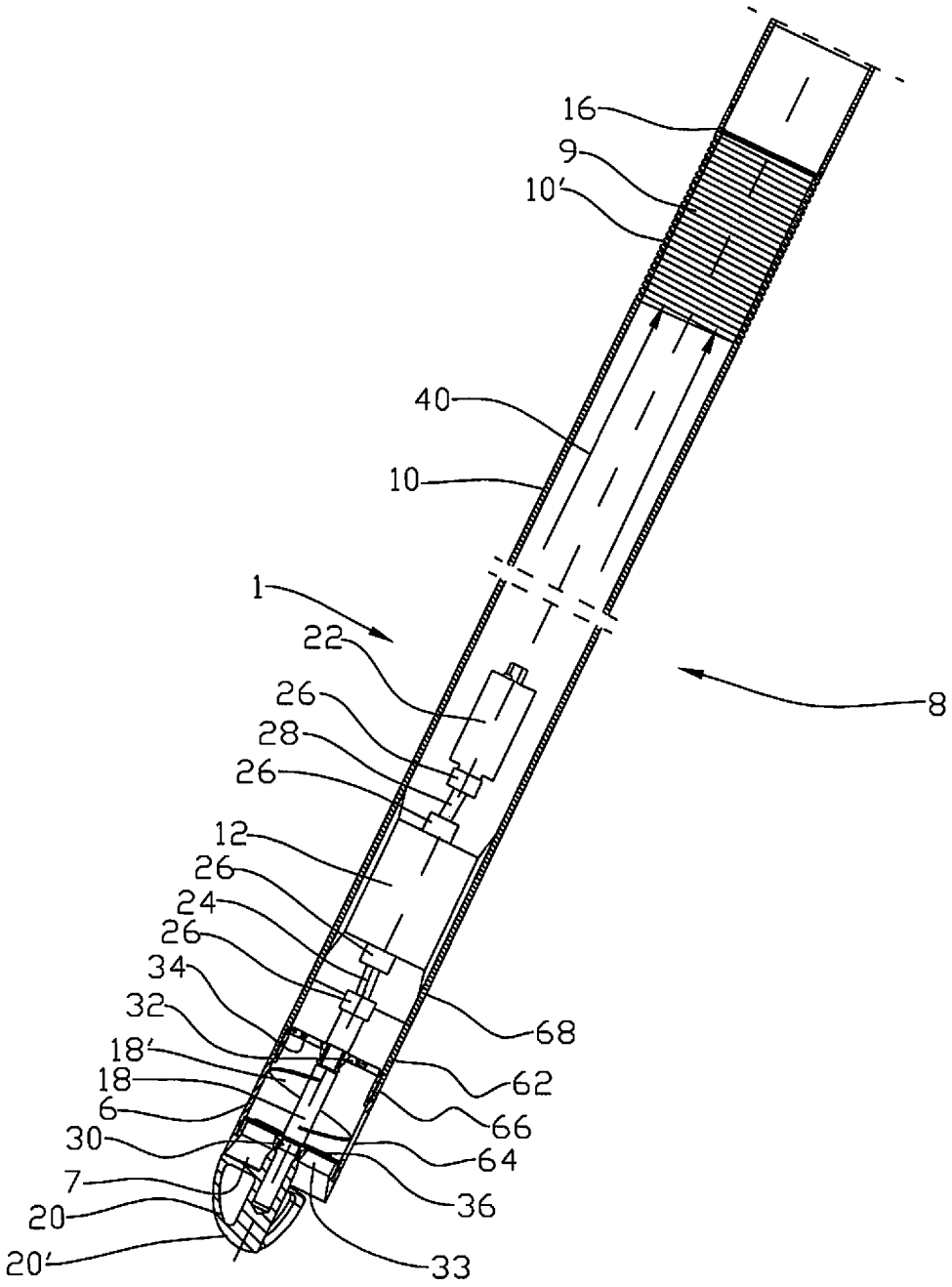
FIG. 5 shows a longitudinal section, on the same scale as FIG. 3, of the collecting device in a further alternative embodiment.

The collecting device 1 is shown in a further alternative embodiment in FIG. 5. In this embodiment, the motor 22 is positioned at the bottom of the collecting receptacle 8 in a lower portion of a receptacle section 10, 10'. Mounting brackets for the motor 22 and wiring for the energy supply to the motor 22 are not shown. This embodiment has the advantage of allowing the collecting receptacle 8 to be without any internal obstructions from the motor 22 to the top section 16 without supports for a driveshaft 28. This simplifies the assembly of several receptacle sections 10, 10' into one collecting receptacle 8. It also makes there be fewer restrictions and obstructions along the flow path 40.

Figure 6:
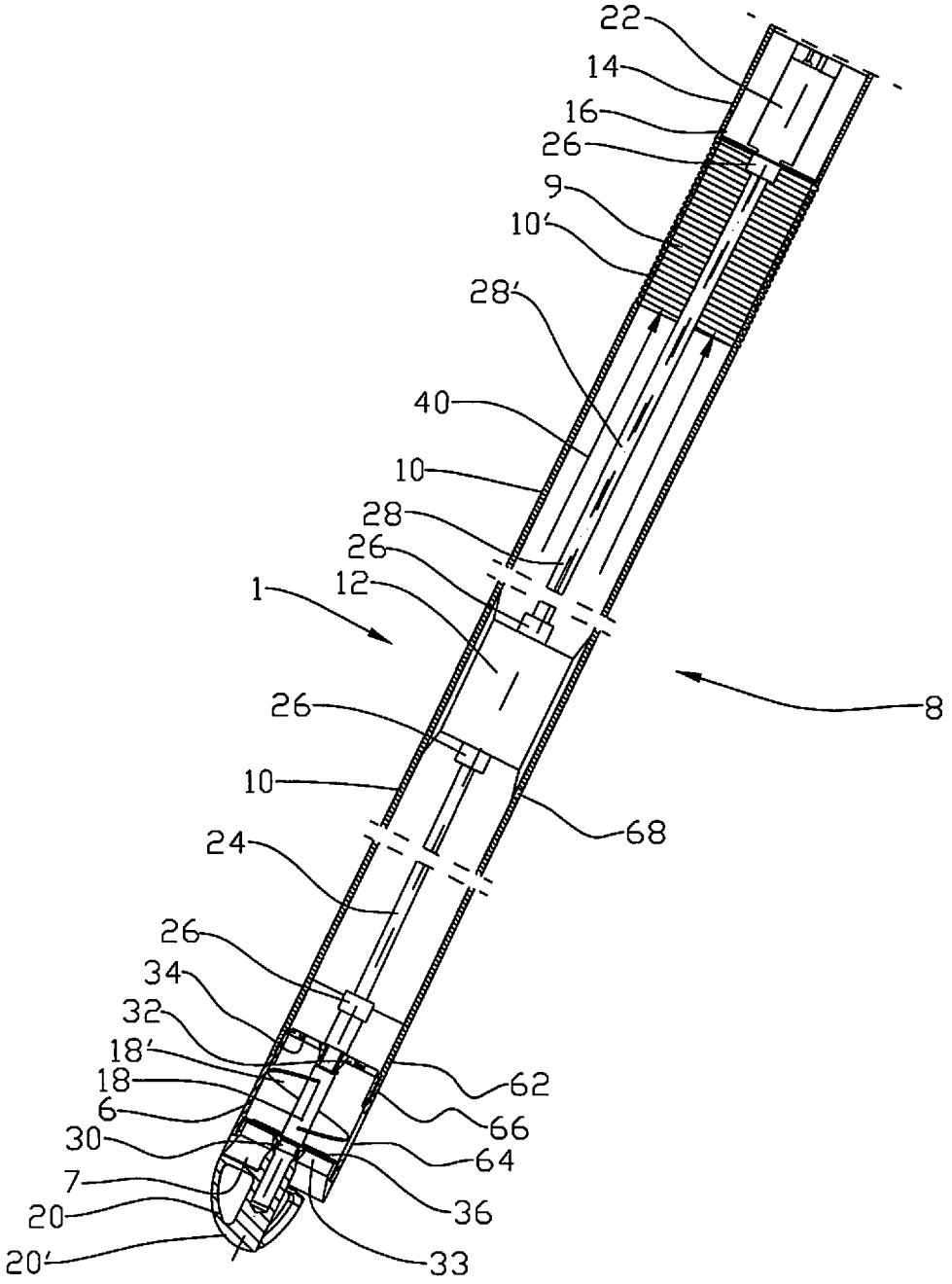
FIG. 6 shows a longitudinal section, on the same scale as FIG. 3, of the collecting device in a further alternative embodiment.

The collecting device 1 is shown in a further alternative embodiment in FIG. 6. In this embodiment, the collecting device 1 is provided with at least one receptacle section 10 on the suction side of the Mono pump 12 and at least one screen receptacle 10' on the delivery side of the Mono pump 12. Collected debris in the collecting receptacle 8 on the suction side of the Mono pump 12 is retained by the closing device 36 so that it cannot flow out of the collecting receptacle 1. FIG. 5 shows an embodiment in which the smooth portion 28' of the driveshaft 28 has been carried through the entire part of the collecting receptacle 8 that is on the delivery side of the Mono pump 12. The intermediate shaft 24 is also shown as a smooth shaft.

In an embodiment not shown, the collecting device 1 shown in FIG. 6 may be provided with a driveshaft 28 with screw blades 29 as shown in FIG. 3. The driveshaft 28 may have a smooth portion 28' extending through the top section 16. In a further (not shown) embodiment, the shaft 24 may be provided with a number of screw blades (not shown). In further embodiments not shown, an intermediate shaft 24 with or without screw blades may be combined with a driveshaft 28 with or without screw blades 29.

In an embodiment not shown, the collecting device 1 shown in FIG. 6 may be provided with a motor 22 in a lower portion of a receptacle section 10, 10' as shown in FIG. 5. The shaft 24 may be without screw blades as shown in FIG. 6 or with screw blades (not shown).

Figure 7:
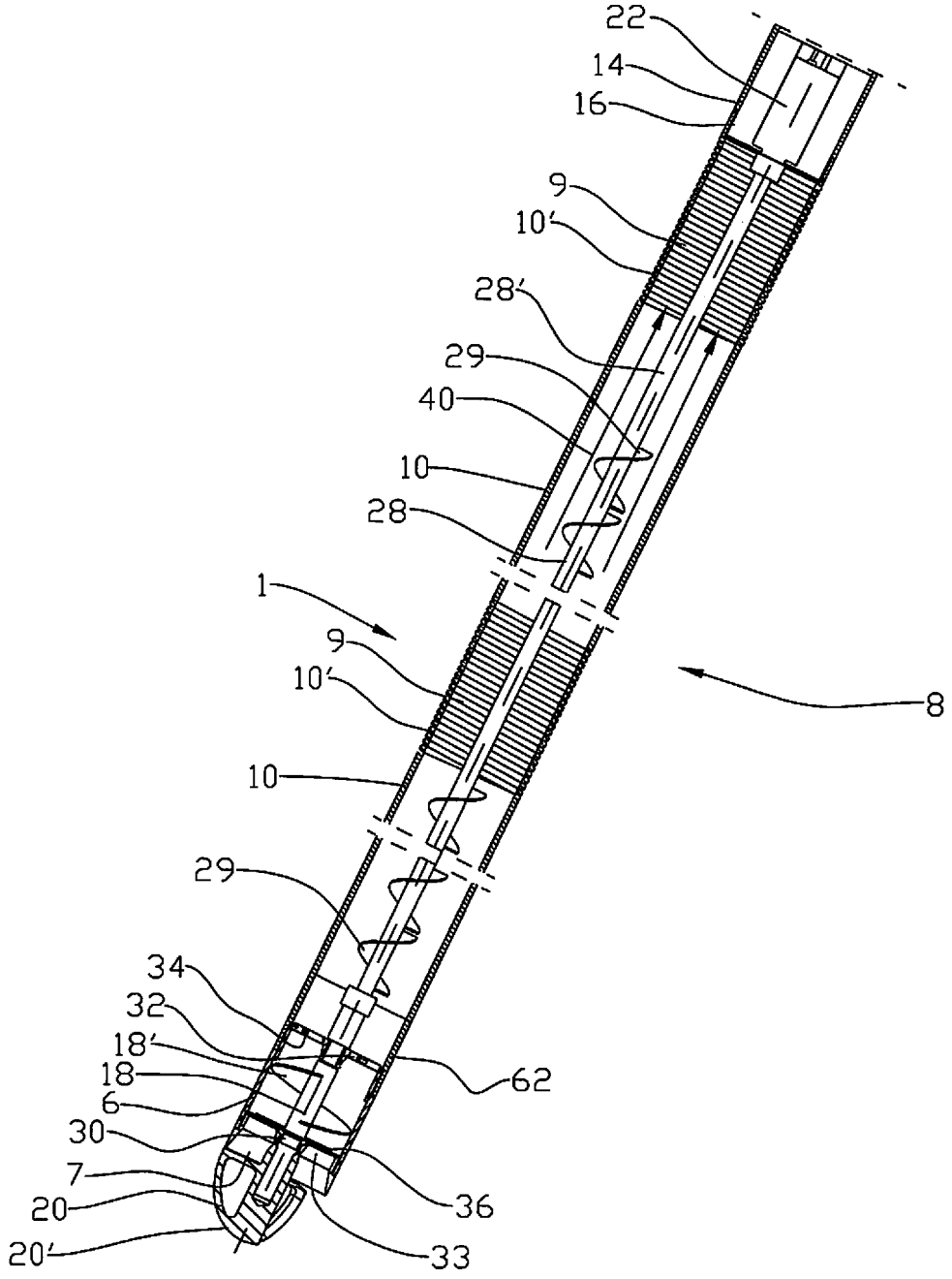
FIG. 7 shows a longitudinal section, on the same scale as FIG. 3, of the collecting device in a further alternative embodiment.

The collecting device 1 is shown in a further alternative embodiment in FIG. 7. In this embodiment, the conveyor 18 is connected directly to the motor 22 via the driveshaft 28. The driveshaft 28 may be smooth like the driveshaft 28 shown in FIG. 4. The driveshaft 28 may be provided with a number of screw blades 29 like the driveshaft 28 shown in FIG. 3. In one embodiment, the driveshaft 28 may be provided with an upper smooth portion 28' nearest to the motor 22, like the driveshaft shown in FIG. 3.

When the collecting device 1 is being displaced into the well pipe 2 by means of a wireline tractor (not shown), for example, the propulsion resistance of the wireline tractor increases when the collecting device 1 is being moved into debris. It may be beneficial to pull the collecting device 1 back somewhat when the debris has been localized. Then the collecting device 1 is activated and the collecting device 1 is eased into the debris with the conveying device 18 activated, tool 20 activated and pump 12 activated. Thereby the debris is loosened while, at the same time, the tool 20 is feeding the debris into the conveying device 18. The debris is then displaced internally through the feed pipe 6 by means of the rotating conveying device 18 while, at the same time, the debris is mixed with ambient fluid entering through at least one of the openings 64, 66, 68 directed radially. The mixture is carried up to the suction side of the Mono pump 12 through the openings 34 directed axially in the inner bearing housing 32. The Mono pump 12 pumps the mixture of debris and ambient fluid into the collecting receptacle 8.

In well pipes 2 oriented vertically, the debris may form a relatively solid bridge or plug. The tool 20 will dig loose debris in the surface of the bridge. Fluid present on the surface of the bridge will mix with the debris and a mixture of fluid and debris is carried into the feed pipe 6. Ambient fluid may also enter the feed pipe 6 through the main openings 64. The conveying device 18 will further mix debris and fluid together and carry this mixture to the suction side of the Mono pump 12. The mixture is carried through the Mono pump 12 and out on the delivery side of the Mono pump 12. The mixture is carried at a pressure higher than the ambient pressure upwards in the collecting receptacle 8. In one embodiment as shown, in which the driveshaft 28 is provided with screw blades 29 in a portion, the screw blades 29 will further contribute to carrying the mixture of fluid and debris upwards in the collecting receptacle 8. The fact that the debris is on the delivery side of the Mono pump 12 will alone enable the use of an extended collecting receptacle 8. The fact that the driveshaft 28 is provided with screw blades 29 will, in combination with the fact that they are on the delivery side of the Mono pump, further contribute to enabling the use of an extended collecting receptacle 8.

The openings 34 in the inner bearing housing 32 are chosen in a size that prevents particles that might damage the Mono pump 12 from being carried up to the Mono pump 12.

If the debris forms a bridge which is so loose that the collecting device 1 sinks into the debris until this covers the main openings 64, the loosened matter could be too dry for the Mono pump 12 to work efficiently. The relief openings 66 are therefore opened so that ambient fluid may enter the feed pipe 6 through the relief openings 66 from the annulus between the collecting device 1 and the well pipe 2. If the debris is so loose that the relief openings 66, too, are covered up, the auxiliary openings 68 are opened. Ambient fluid may then enter the collecting device 1 between the inner bearing housing 32 and the Mono pump 12 through the auxiliary openings 68 from the annulus between the collecting device 1 and the well pipe 2. The third openings 68 are chosen in a size that prevents particles that could damage the Mono pump 12 from flowing through the third openings 68. Thereby it is ensured that the Mono pump 12 is supplied with a mixture of debris and ambient fluid.

The mixture of debris and fluid is carried upwards in the collecting receptacle 8 to the top section 16 along the flow path 40. Fluid exits through the wall screen 9 as the pressure inside the collecting receptacle 8 is greater than the ambient pressure. The particulate debris which has a size that is larger than the light opening of the wall screen 9 is retained by the wall screen 9 and separated from the fluid. The particles separated are collected in the collecting receptacle 8.

When the collecting receptacle 8 has been filled up with debris, the Mono pump 12 is stopped. Fluid and particles cannot flow through the Mono pump 12 when the rotor (not shown) is stationary relative to the stator. Therefore, at a standstill, the Mono pump 12 will function as a check valve which prevents the mixture of fluid and particles from flowing out of the collecting receptacle 8 and out through the feed pipe 6 when the collecting device 1 is being returned to the surface where the collecting receptacle 8 is emptied.

The cleaning operation is repeated until the debris has been removed.

In deviated wells, whether ERD wells or horizontal wells, the method is the same. In such wells, debris does not form bridges. In most cases, one or more of the main openings 64 will face upwards and not be buried in debris. This ensures that ambient fluid will enter the feed pipe 6 and become mixed with loosened debris there.

When the collecting device 1 in an embodiment as shown in FIG. 7 is displaced into the well pipe 2 by means of a wireline tractor (not shown), for example, the propulsion resistance of the wireline tractor increases when the collecting device 1 is being moved into debris. It may be beneficial to pull the collecting device 1 back somewhat when the debris has been localized. Then the collecting device 1 is activated and the collecting device 1 eased into the debris with the transport device 18 activated and tool 20 activated. Thereby the debris is loosened at the same time as the tool 20 is feeding the debris into the conveying device 18. The debris is then moved internally through the feed pipe 6 by means of the rotating conveying device 18 into the collecting receptacle 8. The debris and entrained ambient fluid are carried at a pressure to higher than the ambient pressure upwards in the collecting receptacle 8.

In one embodiment as shown, in which the driveshaft 28 is provided with screw blades 29 in a portion, the screw blades 29 will further contribute to the mixture of fluid and debris being carried upwards in the collecting receptacle 8. Fluid flows out of the wall screen 9 in the screen receptacle 10'. The large screen area enables the use of an extended collecting receptacle 8.

It should be noted that all the above-mentioned embodiments illustrate the invention, but do not limit it, and persons skilled in the art may construct many alternative embodiments without departing from the scope of the attached claims. In the claims, reference numbers in parentheses are not to be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A collecting device for loosening and collecting debris in a well, the collecting device comprising:
- a first end portion and a second end portion;
- a collecting receptacle between the first end portion and the second end portion including at least one receptacle section and at least one screen receptacle with a wall screen;
- a motor;
- at the first end portion, the collecting device further includes:
  - a feed pipe;
  - a conveying screw in the feed pipe driven by the motor, the conveying screw being arranged to move the debris in towards the collecting receptacle;
  - a tool at a leading end portion of the conveying screw;
  - a Mono pump at a trailing end portion of the conveying screw and connected to the motor, the Mono pump forming a suction side and a pressure side;
  - the at least one screen receptacle being in a flow path on a delivery side of the Mono pump between the Mono pump and the second end portion;
  - the conveying screw being arranged to move the debris to the Mono pump:
  - wherein the conveying screw is supported in an outer bearing housing in the feed pipe, the outer bearing housing is provided with a through open directed axially, the outer bearing housing is provided with a closing device on a side facing the conveying screw.

2. The collecting device according to claim 1, wherein the collecting device further includes at least one receptacle section in the flow path on a suction side of the Mono pump.

3. The collecting device according to claim 1, wherein the conveying screw is connected to the motor in a motor housing positioned in the second end portion of the collecting device, and the motor drives the conveying screw via a driveshaft.

4. The collecting device according to claim 1, wherein a motor housing with the motor is positioned in the second end portion of the collecting device, and the motor drives the Mono pump via a driveshaft provided with articulations.

5. The collecting device according to claim 1, wherein the motor positioned in a lower portion of a receptacle section on a delivery side of the Mono pump, and the motor drives the Mono pump via a driveshaft provided with articulations.

6. The collecting device according to claim 1, wherein the conveying screw is connected to the Mono pump with an articulated intermediate shaft.

7. The collecting device according to claim 1, wherein the feed pipe includes at least one through main inlet opening in a wall and is further provided with a plurality of through inlet relief openings directed radially, distributed around the circumference of the feed pipe.

8. The collecting device according to claim 7 wherein the at least one through main inlet opening is distributed around the circumference of the feed pipe.

9. The collecting device according to claim 7, wherein at least one through main inlet opening is elongated in a longitudinal direction of the collecting device.

10. The collecting device according to 7, wherein at least one of the at least one through main inlet opening and the plurality of through inlet relief openings is closable.

11. The collecting device according to claim 1, wherein, in a portion, a driveshaft is provided with a screw blade.

12. The collecting, device according to claim 1, wherein an upper portion of a driveshaft is smooth.

13. The collecting device according to claim 1, wherein, at a standstill, the Mono pump functions as a check valve between the at least one receptacle section on the delivery side of the Mono pump and the feed pipe.

14. The collecting device according to claim 1, wherein, the conveying screw is supported in an inner bearing housing in the feed pipe and the inner bearing housing is provided with through openings directed axially, the through opening is a screen opening.

15. The collecting device according to claim 14, wherein the feed pipe is a container for particles retained by the screen opening.

16. The collecting device according to claim 1, wherein the collecting receptacle is modular.

17. The collecting device according to claim 16, wherein the wall screens are intentionally positioned along a length of the collecting receptacle.

18. The collecting device according to claim 1, wherein the closing device is a flap valve.

19. A method of loosening and collecting debris in a well by means of a collecting device the method includes:

providing the collecting device with a Mono pump;

providing the collecting device with a closing device in an outer bearing housing in a feed pipe, the outer bearing housing being provided with a through opening directed axially, and the closing device is facing a conveying screw;

displacing the collecting device inside a well pipe up to debris in the well pipe;

activating the collecting device by starting the Mono pump, a conveying screw and a tool;

moving the tool into the debris to loosen the debris;

mixing the debris with an ambient fluid and carrying the debris up to a suction side of the Mono pump;

passing the diluted debris through the Mono pump and into a collecting receptacle on a delivery side of the Mono pump;

separating debris and fluid in the collecting receptacle by letting fluid flow out through the wall screen;

stopping the Mono pump so that separated debris in the collecting receptacle is prevented from flowing out of the collecting device through the feed pipe;

retaining particles within the feed pipe;

displacing the collecting device back and out of the well pipe, and emptying the collecting receptacle of the collecting device of collected debris and the feed pipe of collected particles.

20. The method according to claim 19, wherein the method further includes:

providing the collecting device with a main inlet opening and an inlet relief opening; and mixing debris in the feed pipe with ambient fluid which is flowed into the feed pipe through at least one of the main inlet opening, and the inlet relief opening.

21. The method according to claim 19 wherein the method further includes flowing ambient fluid into the feed pipe selectably through at least one of the inlet openings by closing at least one of the main inlet opening, and the inlet relief opening.

* * * * *